US006892458B2

(12) United States Patent
Shevela

(10) Patent No.: US 6,892,458 B2
(45) **Date of Patent: *May 17, 2005**

(54) APPARATUS AND METHOD FOR REMOVING A COATING MATERIAL FROM TUBING

(75) Inventor: Michael Shevela, Harrison Township, MI (US)

(73) Assignee: SPX Corporation, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/614,198

(22) Filed: Jul. 8, 2003

(65) Prior Publication Data

US 2004/0003499 A1 Jan. 8, 2004

Related U.S. Application Data

(63) Continuation-in-part of application No. 09/942,551, filed on Aug. 31, 2001, now Pat. No. 6,615,493.

(51) Int. Cl.[7] ..... B21F 13/00

(52) U.S. Cl. ..... 30/90.1

(58) Field of Search ..... 30/90.1, 90.2, 30/90.4, 90.9, 91.2

(56) References Cited

U.S. PATENT DOCUMENTS 3,082,523 A * 3/1963 Modes et al. ..... 30/90.1
3,722,092 A * 3/1973 Lukas ..... 30/90.9
6,131,289 A * 10/2000 Tarpill ..... 30/90.6

* cited by examiner

*Primary Examiner*—Dougals D. Watts
(74) *Attorney, Agent, or Firm*—Baker & Hostetler LLP; Marc W. Butler

(57) ABSTRACT

An apparatus and method for removing coating material from tubing is disclosed that includes a tool body, a tubing support, a slider support, a slider accommodated with the slider support, and a blade attached to the slider, wherein the tubing support, and the slider support are accommodated with the tool body. The apparatus can be utilized to remove protective coating materials from steel tubing, by placing the tubing on the tubing support, lowering the blade to the tubing, and rotating the apparatus around the tubing.

20 Claims, 4 Drawing Sheets

APPARATUS AND METHOD FOR REMOVING A COATING MATERIAL FROM TUBING

PRIORITY

This is a continuation-in-part of U.S. patent application Ser. No. 09/942,551, filed Aug. 31, 2001 now U.S. Pat. No. 6,615,493, titled APPARATUS AND METHOD FOR REMOVING A COATING MATERIAL FROM TUBING, the disclosure of which is hereby incorporated by reference.

FIELD OF THE INVENTION

The present invention relates generally to an apparatus and method for removing coating materials from tubing. More particularly, the present invention relates to an apparatus and method for removing a protective coating from steel tubing.

BACKGROUND OF THE INVENTION

In the automotive industry, brake line tubing is manufactured and sold for installing and replacing brake line tubing in vehicles. For example, it is necessary to replace the brake line tubing of a vehicle, when the brake line tubing corrodes. Corrosion to brake line tubing may be caused, in part, by its exposure to elements such as water, salt, and other substances, which may be on the surface of roads.

Over a period of time, the exposure of the brake line tubing to elements, such as water and salt, may cause the brake line tubing to corrode. Recently, some manufacturers of brake line tubing have been coating the brake line tubing with a protective material, such as vinyl or plastic. By adding the protective coating, the brake line tubing is not as susceptible to corrosion, and the life-time of the brake line tubing is extended.

When repair of a braking system involves replacing a portion of the brake line tubing, a portion of the brake line tubing is removed and replaced by a new portion of brake line tubing. If the replacement brake line tubing has a protective coating, such as vinyl, a portion of the vinyl has to be stripped from the tubing to form a connection with the remaining components of the braking system.

The process of replacing brake line tubing, with the brake line tubing that has a protective coating material, involves: 1) removing the existing brake line tubing; 2) removing a portion of the protective coating from the replacement portion of brake line tubing; 3) sliding on a threaded flare nut/screw fitting; 4) flaring the brake line tubing by spreading or widening the tube, so the flared portion of the brake line tubing can be utilized to create the sealing surface with another component of the braking system, such as the master cylinder; and 5) screwing the flare nut with the corresponding flare nut/screw of another component of the braking system.

However, problems may occur in the sealing of the brake line tubing to another component of the braking system. For example, if the plastic coating is not adequately stripped from the brake tubing, it will be difficult to create a flare, on an end of the tubing, that is adequate in quality. In addition, if the brake line tubing is not adequately stripped, then the undesirable plastic coating, remaining on an end of the tubing which has been stripped for flaring, may destroy the quality of the sealing surface between the flare and the other component of the braking system. If the sealing surface is not tight, then the brake fluid, which travels through the tubing, may leak through the sealing surface.

Accordingly, it is desirable to provide a tool for adequately removing a portion of protective coating material from steel tubing. Further, it is desirable to provide a tool for removing a variety of lengths of a protective coating material from the steel tubing. In addition, it is desirable to remove an amount of protective coating material efficiently and precisely.

SUMMARY OF THE INVENTION

In one aspect of the invention, an apparatus for removing a coating material from tubing is provided that includes, a tool body, a tubing support, a slider support, a slider accommodated with the slider support, a blade attached to the slider, and an adjuster attached to the slider support wherein the tubing support, the slider support, and the slider are accommodated with the tool body.

In another aspect of the invention, an apparatus for removing a coating material from tubing is provided wherein the blade has at least a first end that is sharpened.

In another aspect of the invention, an apparatus for removing a coating material from tubing is provided wherein the blade has a second end that is sharpened, in addition to the first end that is sharpened.

In another aspect of the invention, an apparatus for removing a coating material from tubing is provided wherein the blade has at least two ends wherein each end has at least two cutting edges.

In another aspect of the invention, an apparatus for removing a coating material from tubing is provided wherein the adjuster is a rotatable wheel.

In another aspect of the invention, an apparatus for removing a coating material from tubing is provided wherein the tubing support structure includes a first roller and a second roller, and wherein the first roller and the second roller are accommodated with in the tool body.

In another aspect of the invention, an apparatus for removing a coating material from tubing is provided that includes wherein the first roller has a first rim and the second roller has a second rim, and wherein the first rim of the first roller and second rim of the second roller stabilize the tubing on the first roller and the second roller.

In another aspect of the invention, an apparatus for removing a coating material from tubing is provided wherein a first pin and a second pin are utilized to accommodate the first roller and the second roller within the body.

In another aspect of the invention, an apparatus for removing a coating material from tubing is provided wherein the blade is attached to the slider by a fastener.

In another aspect of the invention, an apparatus for removing a coating material from tubing is provided wherein the blade is attached to the slider by a fastener that is a screw.

In another aspect of the invention means for positioning the tubing is provided, as well as means for removing the coating material from the tubing, a means for raising and lowering the removing means, a means for adjusting the raising and lowering means, and a means for supporting the positioning means, the removing means, the raising and lowering means and the adjusting means with each other as a tool.

In another aspect of the invention, an apparatus for removing a coating material from tubing is provided wherein the removing means is a blade.

In another aspect of the invention, an apparatus for removing a coating material from tubing is provided wherein the blade has at least a first end that is sharpened.

In another aspect of the invention, an apparatus for removing a coating material from tubing is provided wherein the raising and lowering includes an adjuster and a slider support.

In another aspect of the invention, an apparatus for removing a coating material from tubing is provided wherein the adjuster is a rotatable wheel.

In another aspect of the invention, an apparatus for removing a coating material is provided wherein the positioning means includes a first roller and a second roller.

In another aspect of the invention, a method for removing a coating material from a tubing is provided that includes, placing tubing on a tubing support accommodated within a tool body, correcting a blade having an end with at least two cutting edges to a slider, providing an adjuster, lowering the end of the blade onto the tubing until the cutting edges pierce the coating material on the tubing, and rotating the tool body around the tubing until the coating material is stripped from the tubing.

In another aspect of the invention, a method for removing a coating material is provided wherein the blade has at least two cutting edges that are sharpened.

In another aspect of the invention, a method for removing a coating material from a tubing is provided that includes, utilizing an adjuster to change a position of the slider.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS

Figure 1:
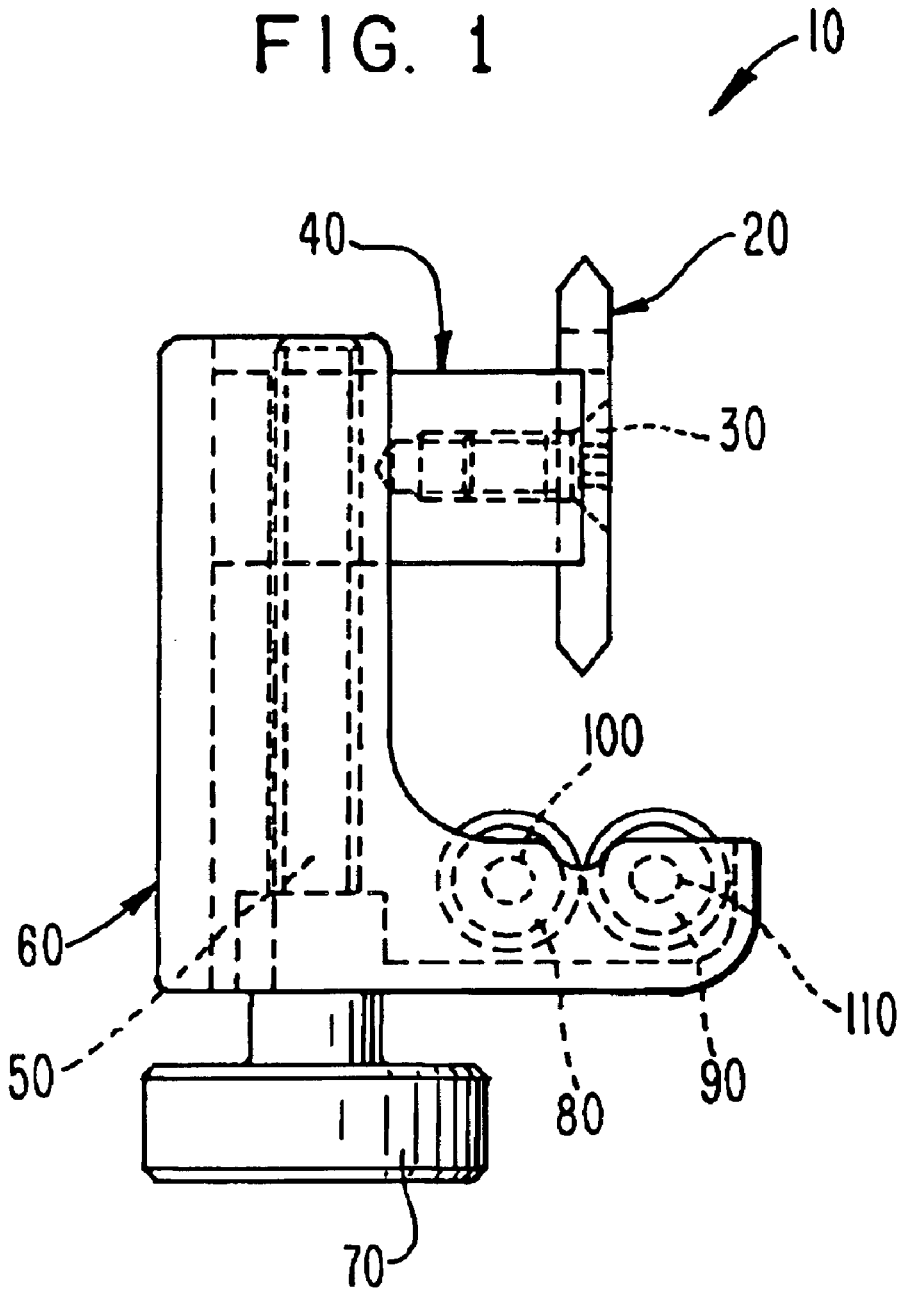
FIG. 1 is a side view of an exemplary embodiment of an apparatus for removing a coating material from tubing, in accordance with the present invention.

An exemplary embodiment of the present invention provides an apparatus for removing a coating material from steel tubing. Referring now to the figures wherein like reference numerals indicate like elements, in FIG. 1 there is shown an exemplary embodiment of a stripping tool, in accordance with the present invention. As shown in FIG. 1, the stripping tool 10 includes a blade 20, as a coating material removing means, and a fastener 30, which attaches to a slider 40. The slider 40 is slidably positioned on a slider support 50. The slider support 50 may be cylindrical in shape and made from metal, plastic, or any other suitable material. The slider support 50 is accommodated within the tool body 60. The tool body may also be formed out of metal, plastic, or another suitable material.

Attached to the slider support 50 is an adjuster 70 for adjusting the location of the slider 40, and consequently, the blade 20. The adjuster 70 may be a thumb wheel. Further, a first roller 80 and a second roller 90, as a positioning means, are accommodated with the tool body 60. In an exemplary embodiment, in accordance with the present invention rollers 80 and 90 are utilized as a tubing support structure. In an exemplary embodiment, the two rollers 80 and 90 are positioned within the tool body by fasteners 100 and 110. The fasteners may be pins, screws, etc. In FIG. 1, pins are utilized for fasteners 100 and 110.

Figure 2:
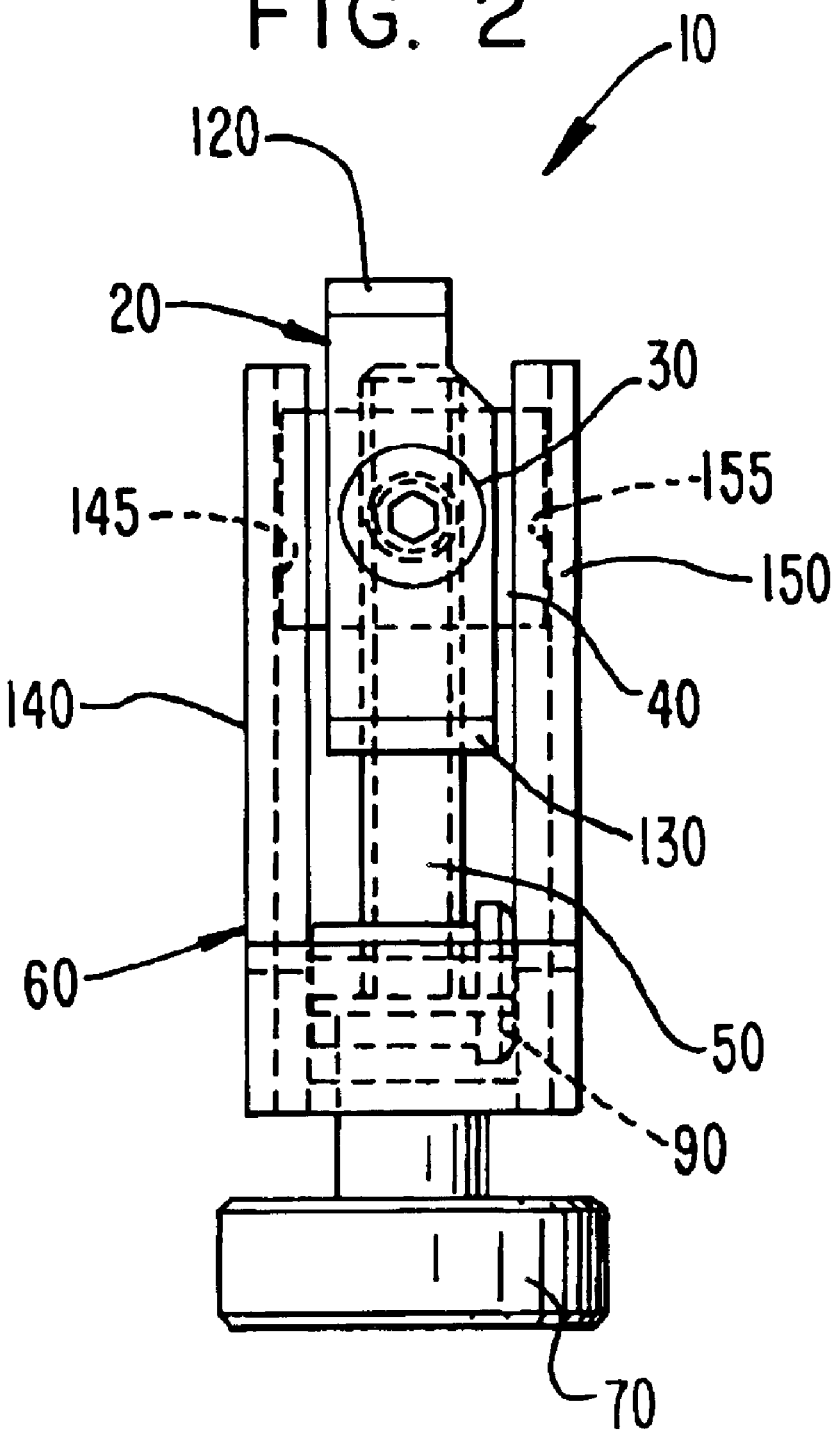
FIG. 2 is a front view of an exemplary embodiment of an apparatus for removing a coating material from tubing, in accordance with the present invention.

FIG. 2 provides another view of the above exemplary embodiment of an apparatus for removing coating material from tubing, in accordance with the present invention. As illustrated in FIG. 2, the blade 20 attaches to a slider 40 by a fastener 30. The fastener 30 may be a screw. The blade 20 may be a single-end blade, in which only one edge is sharpened, or a double-end blade, in which both ends of the blade are sharpened. As shown in FIG. 2, the blade 20 is a double-end blade. The two sharpened ends of blade 20 are blade end 120 and blade end 130. Blades ends 120 and 130 may differ in size. As shown in FIG. 2, blade end 120 is smaller than blade end 130. The blade ends 120 and 130 are utilized to strip a portion of protective coating material, such as plastic or vinyl, from steel tubing. For example, a blade end may be 0.25 inches in length and utilized to strip 0.25 inches or less than 0.25 inches of a coating material from tubing. In another exemplary embodiment of the invention, the blade end may be 0.38 inches in length and may be utilized to strip 0.38 inches of a protective material or more from tubing. It should be understood that a blade of any length may be utilized to strip an amount of protective material that is more or less than the length of the blade. It should be understood that the coating material may be of any material or structure. It should also be understood that the tubing may be hollow or non-hollow and made from any material and may vary in structure.

FIG. 2 also provides a detailed illustration of the tool body 60 according to the exemplary embodiment. The slider 40 is slidably positioned within a first wall 140 and a second wall 150 of the tool body 60. Further, as shown in FIG. 2, the slider 40, the slider support 50, and rollers 80 and 90, which constitute a support structure for the tubing, are located between the first wall 140 and the second wall 150. Groove 145 and groove 155 are utilized to accommodate the slider support 50 with the first wall and the second wall, such that the slider support 50 is slidably positioned between the first wall 140 and the second wall 150, such that the slider 50 can be raised and lowered by the adjuster 70. The adjuster 70 and slider support 50 are a raising and lowering means.

Figure 3:
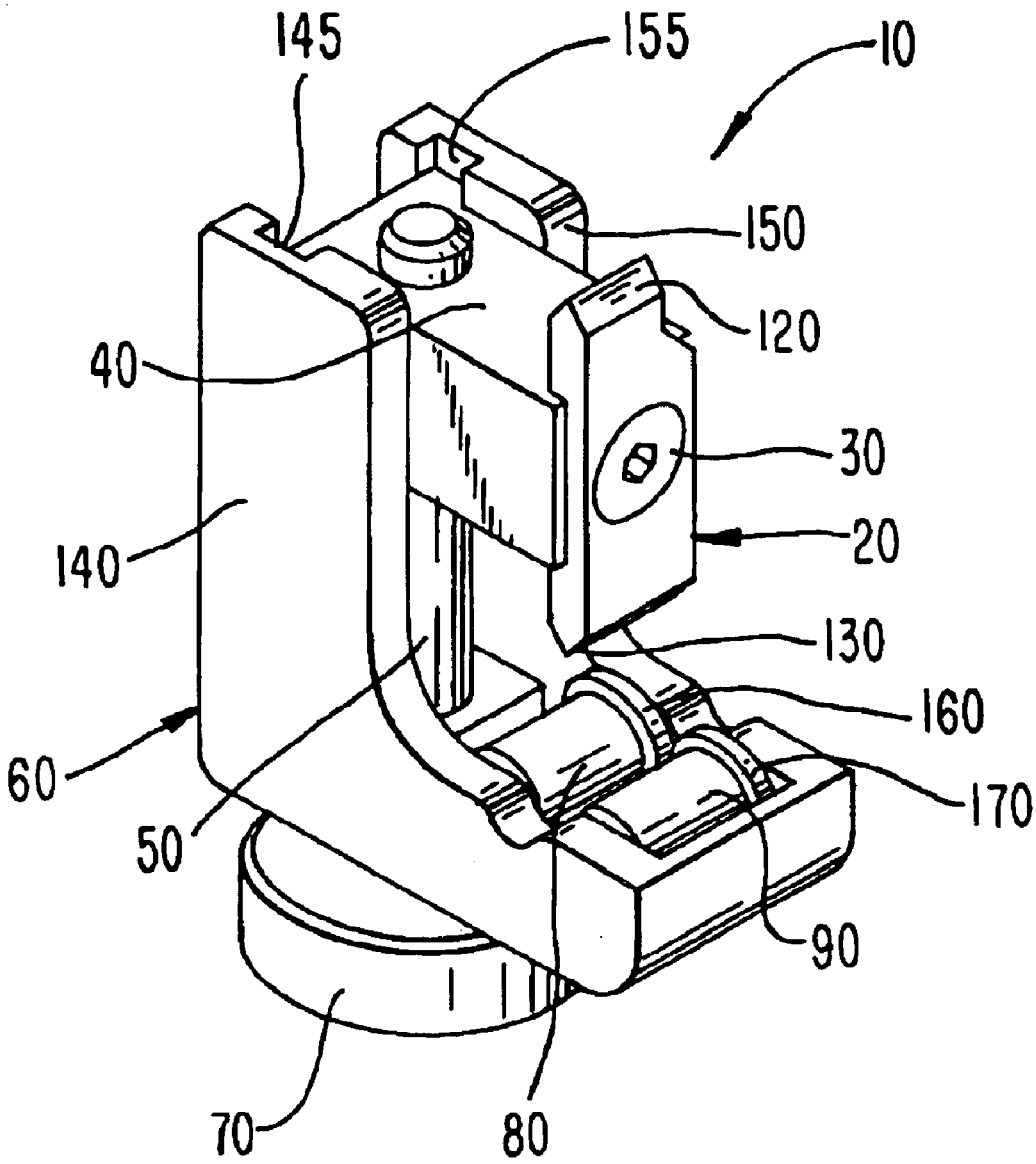
FIG. 3 is a perspective view of an exemplary embodiment of an apparatus for removing a coating material from tubing, in accordance with the present invention.

Referring to FIG. 3, during operation of the stripper tool 10, the tubing (not shown) is placed between two rollers 80 and 90 and against the shoulder portions, for example, rims 160 and 170 of rollers 80 and 90, respectively. The adjuster 70 is utilized to move the positioning of the slider 40, and can be used to move the slider 40 and blade 20 toward the tubing (not shown).

To remove the protective coating material, such as plastic or vinyl, from the tubing, the blade 20 should be positioned, by utilizing the adjuster 70, such that the blade 20, preferably, slightly pierces the tubing. The stripping tool 10, in its entirety, should be rotated around the tubing, until the protective coating material is removed or removable from the tubing. While rotating the tool 10 around the tubing to remove the protective coating material, it may be necessary to move the blade 20 closer to the tubing. For example, it may be necessary to adjust the blade 20 if the tubing is not positioned securely between rollers 80 and 90 and the blade 20.

An additional feature, of an exemplary embodiment of a stripping tool 10, in accordance with the present invention, is the interchangeability of the blade 20. The blade 20 may be unfastened from the fastener 30 to replace the blade 20 in its entirety or to select which blade end 120, 130 will perform the cutting. Alternately, the slider 40 and blade 20 can be simultaneously removed by adjusting the adjuster 70 until the slider 40 can be removed from the slider support 50. Thus, both the blade 20 and the slider 40 can be simultaneously replaced, or the slider 40 and blade 20, while integrated, may be flipped over to select which blade end 120, 130 will perform the stripping.

Figure 4:
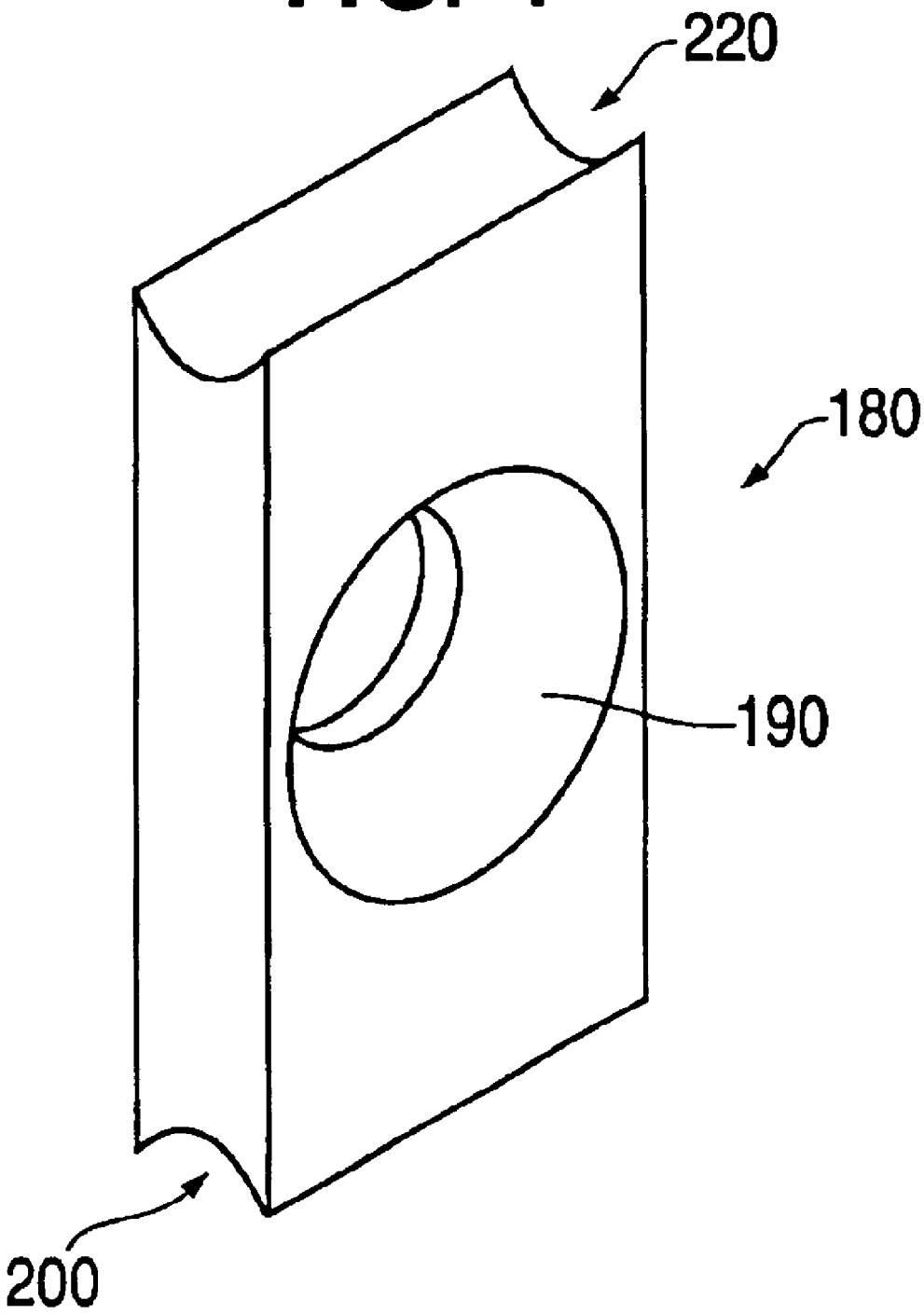
FIG. 4 is a perspective view of an alternative embodiment of the blade used in an apparatus for removing a coating material from tubing.

FIG. 4 shows an alternative embodiment of a blade design which may be utilized in accordance with the present invention. The blade 180 contains blade ends 200, 220 for performing cutting. The blade 180 may additionally be fastened to the slider 40. In a preferred embodiment, blade 180 contains an opening through which a fastener 30 may be inserted and connected to the slider 40. Each blade end 200, 220 contains at least two cutting edges to perform the cutting. This design is useful for providing additional cutting edges for removing a coating material from tubing during the cutting process. Additionally, the blade design shown in FIG. 4 serves to facilitate additional control of the tubing between the rollers 80 and 90 and the blade 180 during the cutting process.

It is to be understood that the invention is not limited in its application, the details of construction, and to the arrangements of the components set forth in the above description or illustrated in the drawings. The invention is capable of other embodiments and of being practiced and carried out in various ways. Also it is to be understood that the phraseology and terminology employed herein, as well as the abstract, are for the purpose of description and should not be regarded as limiting.

What is claimed is:

1. An apparatus for removing a coating material from a tubing, comprising:

a tool body;

a tubing support having a first roller having a first rim and a second roller having a second rim, wherein the first roller and second roller are accommodated within the body, and wherein the first rim and the second rim stabilize the tubing on the first roller and the second roller;

a slider support;

a slider accommodated with the slider support and generally located above the tubing support;

a blade having an end with at least two cutting edges, said blade attached to the slider, wherein the tubing support, the slider support and the slider are accommodated within the tool body; and an adjuster attached to the slider support and generally located below the tubing support.

2. The apparatus according to claim 1, wherein the blade has at least two ends, each end having at least two cutting edges.

3. The apparatus according to claim 1, wherein the blade has at least two cutting edges that are sharpened.

4. The apparatus according to claim 2, wherein the at least two cutting edges are sharpened.

5. The apparatus according to claim 1, wherein the adjuster is a rotatable wheel.

6. The apparatus according to claim 1, further comprising a first pin and a second pin which are utilized to accommodate the first roller and the second roller with the tool body.

7. The apparatus according to claim 1, wherein the blade is attached to the slider support by a fastener.

8. The apparatus according to claim 7, wherein the fastener is a screw.

9. An apparatus for removing a coating material from tubing, comprising:

means for positioning the tubing including a first roller and a second roller, wherein the first roller and the second roller each have a rim to stabilize the tubing when the tubing is positioned on the first roller and the second roller;

means for removing the coating material from the tubing, said removing means having an end with at least two cutting edges, said removing means generally located above the positioning means;

means for raising and lowering the removing means;

means for adjusting the raising and lowering means, said adjusting means generally located below said positioning means; and means for supporting the positioning means, the removing means, the raising and lowering means and the adjusting means with each other as a tool.

10. The apparatus according to claim 9, wherein the means for removing the coating material is a blade.

11. The apparatus according to claim 10, wherein the at least two cutting edges are sharpened.

12. A method for removing a coating material from a tubing, comprising:

placing the tubing on a tubing support accommodated within a tool body;

connecting a blade having an end with at least two cutting edges to a slider and generally locating said slider above the tubing support;

providing an adjuster, wherein the adjuster includes a rotatable wheel, and connecting said adjuster to the slider at a location generally below the tubing support;

lowering the end of the blade onto the tubing until the cutting edges pierce the coating material on the tubing by changing the position of the slider via the adjuster; and rotating the tool body around the tubing until the coating material is stripped from the tubing.

13. The method according to claim 12, wherein the at least two cutting edges are sharpened.

14. An apparatus for removing a coating material from a tubing, comprising:

a tool body;

a tubing support;

a slider support;

a slider accommodated with the slider support; and a blade having an end with at least two cutting edges attached to the slider, wherein the tubing support, the slider support, and the slider are accommodated within the tool body.

15. The apparatus according to claim 14, wherein the at least two cutting edges are sharpened.

16. An apparatus for removing a coating material from a tubing, comprising:

a tool body;

a tubing support;

a slider support;

a slider accommodated with the slider support and generally located above the tubing support;

a blade having an end with at least two cutting edges, said blade attached to the slider, wherein the tubing support, the slider support and the slider are accommodated within the tool body; and an adjuster attached to the slider support and generally located below the tubing support, wherein the adjuster includes a rotatable wheel.

17. The apparatus according to claim 16, wherein the blade is attached to the slider support body by a fastener.

18. The apparatus according to claim 17, wherein the fastener is a screw.

19. The apparatus according to claim 16, wherein the adjuster is a rotatable wheel.

20. The apparatus according to claim 16, wherein the slider support is a shaft.

* * * * *